United States Patent [19]

Zell et al.

[11] Patent Number: 4,530,131

[45] Date of Patent: Jul. 23, 1985

[54] AUTOMATIC VACUUM RECYCLABLE SYSTEM FOR CHEMICAL-THERMO CLEANING OF SHIP TANKS AND BILGES

[75] Inventors: Warren E. Zell, Fountain Valley; Charles E. Imel, Ojai, both of Calif.; Richard D. Saam, Corpus Christi, Tex.; Peter J. Hearst, Oxnard, Calif.; Nicholas J. Olah, Oxnard, Calif.; Adolph Bialecki, Oxnard, Calif.; Rececca L. Biggers, Oxnard, Calif.

[73] Assignee: The United States of America as represented by the Secretary of the Navy, Washington, D.C.

[21] Appl. No.: 546,253

[22] Filed: Oct. 28, 1983

[51] Int. Cl.[3] ..... B08B 3/02

[52] U.S. Cl. ..... 15/321; 15/302; 134/166 R; 210/196

[58] Field of Search ..... 15/302, 321; 134/167 R, 134/166 R, 107, 108, 109, 110, 99, 94; 210/258, 195.1, 196

[56] References Cited

U.S. PATENT DOCUMENTS

| | | | |
|---|---|---|---|
| 1,842,099 | 1/1932 | Johnson | 134/107 X |
| 2,090,143 | 8/1937 | Nonhebel | 210/258 X |
| 3,022,792 | 2/1962 | Perkins | 134/108 X |
| 3,140,828 | 7/1964 | Galanor | 134/108 X |
| 3,775,053 | 11/1973 | Wisdom | 15/302 X |
| 4,040,960 | 8/1977 | Taylor et al. | 210/195.1 X |
| 4,153,968 | 5/1979 | Perkins | 15/321 |
| 4,156,621 | 5/1979 | Andrews et al. | 134/108 X |
| 4,197,200 | 4/1980 | Alig | 210/195.1 X |
| 4,244,523 | 1/1981 | Looper | 134/167 R X |

OTHER PUBLICATIONS

European Patent (PCT) 82/00783, Mar. 18, 1982, Oberdorfer.

*Primary Examiner*—Philip R. Coe
*Assistant Examiner*—Frankie L. Stinson
*Attorney, Agent, or Firm*—Robert F. Beers; Joseph M. St. Amand

[57] ABSTRACT

The automatic vacuum recyclable system for chemically-thermo cleaning tanks and bilges primarily comprises a makeup, storage and heating unit, a pressure pumping and spraying unit, a vacuum and separation unit, and a filtration unit. The system functions to clean tanks and bilges without the need for a work crew to be inside during actual surface cleaning operations.

18 Claims, 1 Drawing Figure

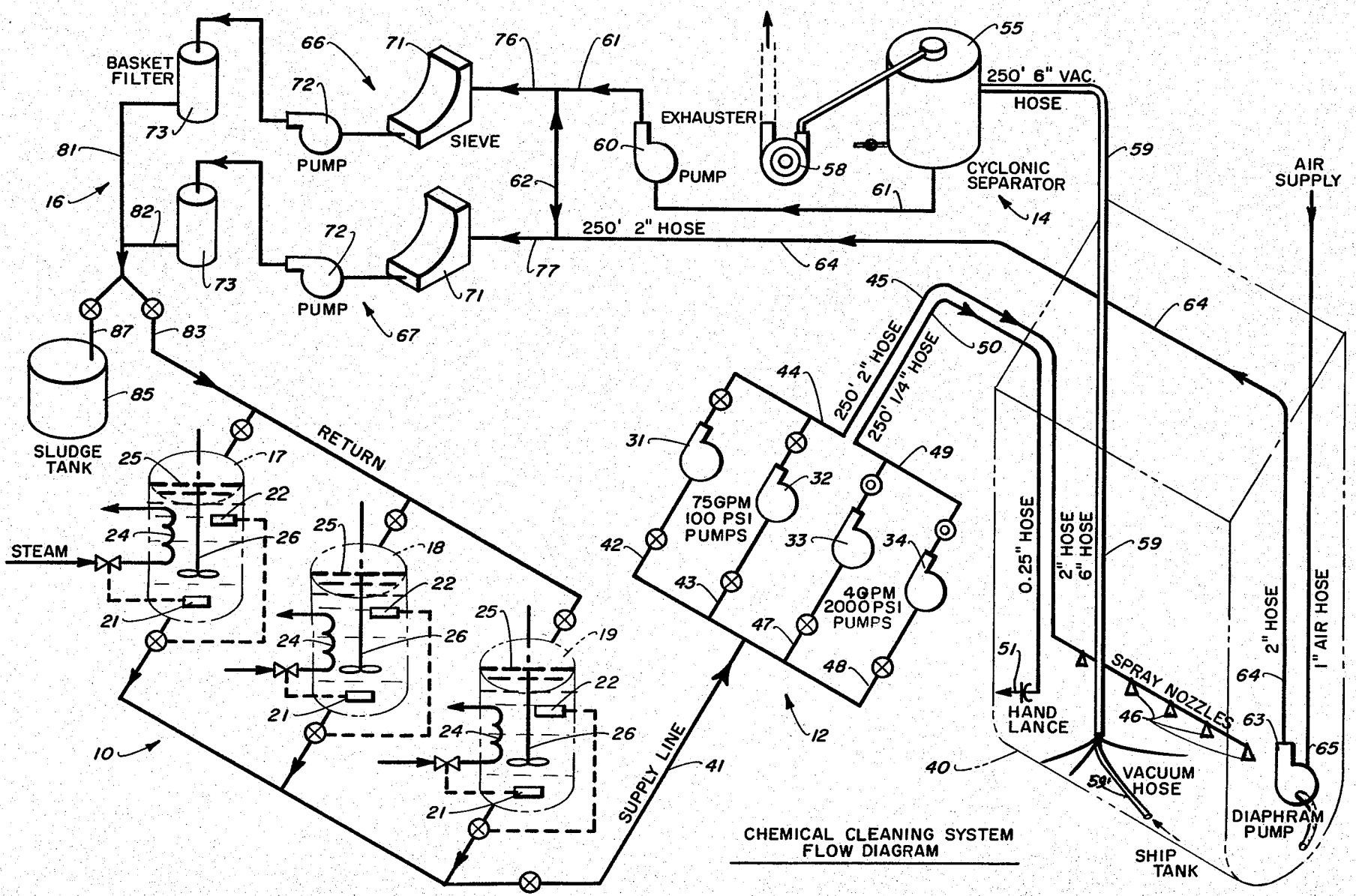
AIR SUPPLY
1" AIR HOSE
2" HOSE
DIAPHRAM PUMP
SPRAY NOZZLES
VACUUM HOSE
SHIP TANK
250' 6" VAC. HOSE
CYCLONIC SEPARATOR
2" HOSE
6" HOSE
0.25" HOSE
HAND LANCE
250' 1/4" HOSE
250' 2" HOSE
40GPM 200PSI PUMPS
75GPM 100 PSI PUMPS
SUPPLY LINE
CHEMICAL CLEANING SYSTEM FLOW DIAGRAM
EXHAUSTER
PUMP
250' 2" HOSE
SIEVE
PUMP
PUMP
BASKET FILTER
RETURN
SLUDGE TANK
STEAM

AUTOMATIC VACUUM RECYCLABLE SYSTEM FOR CHEMICAL-THERMO CLEANING OF SHIP TANKS AND BILGES

BACKGROUND OF THE INVENTION

This invention is related to the cleaning of ship tanks and bilges, and more particularly to a closed circuit system and process for cleaning and preparing enclosed large surfaces for recoating.

Closed circuit cleaning of boiler tubes is not unique. However, chemical cleaning of in-place structures is limited due to the difficulty of delivering and controlling hot acid and caustic liquids safely. Shipyards that currently chemically clean ship spaces are strictly required to employ manual hand spray applications with subsequent pump removal of the cleaning liquid. The results are limited and less than desirable due to the constraints on personnel spraying caustic hot liquid and consequently being subjected to vapors, and flooding of the work area. The operations are also limited by safety factors necessitating lower pressure ranges.

Prior methods used a single tank operation which was subject to considerable down-time during mixing and heating stages, and was also susceptible to fluid contamination, requiring subsequent dumping, if foreign matter was returned to the supply tank. The old method of hand spraying limited the allowable volume flow of working fluids and did not allow for sufficiently high pressure applications. In addition, the previous methods which used hydrochloric acid solutions required a crew to enter the tanks to be cleaned and work with hand sprays. The considerable vapors and mists created by spraying are harmful to personnel working in the tanks and performing the cleaning operations.

The system of the present invention for chemically cleaning tanks and bilges provides an automatic process for delivering high pressure and high temperature stripping and cleaning solutions to large surface areas, with consequent recycling of the chemical solutions for repeated pass operations. The invention overcomes the disadvantages inherent in the prior methods and eliminates many of the disadvantages and constraints previously limiting the cleaning operations.

BRIEF DESCRIPTION OF THE DRAWING

The figure of drawing is a schematic flow diagram of a preferred embodiment of the chemical cleaning system of the invention.

DESCRIPTION OF THE PREFERRED EMBODIMENT

The automatic vacuum recyclable system for chemical-thermo cleaning of tanks and bilges of this invention consists primarily of four modules: Tank module 10, pump module 12, vacuum module 14 and filter module 16.

Tank module 10, for example, comprises three supply tanks 17, 18 and 19 having, for example, a working capacity of 700 gallons for preparing, holding, and recirculating chemical cleaning solutions. The three tanks provide a supply tank, make-up tank, and a buffer tank. Each of tanks 17, 18 and 19 include an automatic temperature control 21 and a level control 22, and is equipped with a steam heat exchanger coil 24 (e.g., 1,000,000 BTU/hr) to heat and maintain the working solutions 25 in the tanks at the desired temperature, depending on requirements, and are actuated via respective temperature controls 21. The solutions in tanks 17, 18 and 19 are maintained at between 100° F. and 200° F., for example. Derusting citric acid solution is maintained at a temperature of approximately 180° F., for example. The level control 22 for each of the tanks is provided for filling the tanks during preparation of the cleaning solutions and to maintain proper tank level and flow rate, e.g., 75 gpm flow rate to the ship tanks 40 for continuous recirculation. Mixers 26 are provided for thoroughly mixing solutions. Tanks, 17, 18 and 19 are interconnected to permit substantial variability of operation by selecting the valves and pumps to be utilized. Tanks may be selected for single-tank, dual-tank, or three-tank operation. Additional tanks can be added if desired. Also, the three tanks can be operated as independent chemical supplies where required (i.e., detergent for cleaning; caustic for paint removal; citrus acid for rust removal, etc.).

The use of three supply tanks, 17, 18 and 19, for example, in the tank module 10, provides for flexibility in having supply, make-up and buffer operations. Should return fluid become contaminated in some manner, it can be isolated in one of the tanks, if desired.

The pump module 12, for example, comprises four pumps for alternate operation—two high volume pumps 31 and 32 (e.g., 75 gpm at 100 psi) and two high pressure-low volume pumps 33 and 34 (e.g., 4 gpm at 2000 psi; which can be extended to 10,000 psi) to supply the chemical working chemical solutions to the surfaces to be treated, e.g., ship tanks 40, bilges, etc., for stripping and chemical cleaning. Stripping solutions may be of varied compositions depending on the chemical nature of the coating to be removed. A caustic solution with or without chelating chemicals can be used with alkyd paints. Paint stripping compositions containing solvents can be used within safety ranges on epoxy coatings. The two low pressure pumps 31 and 32 deliver working chemical solutions from module 10, via valved supply lines 41, 42, 43 and 44, through a long high volume hose 45 (e.g., 250 ft., 2 in. ID hose) to a system of spray nozzles 46. Under certain conditions the hoses can be replaced by metal piping with universal joints at appropriate intervals (i.e., high pressure; strong acids; through sensitive working spaces.) Spray nozzles 46 are geometrically arranged to strategically spray hot stripping or cleaning fluid to all areas in tank 40 at the pressures and volumes required. All personnel are evacuated from the work area prior to spraying. The absence of a crew in the area being cleaned allows high pressure and high temperature application of the cleaning fluids onto the metal surface of areas being cleaned. The two high pressure pumps 33 and 34 provide solution at high pressure for removing hard rust. The high pressure pumps deliver cleaning solutions from module 10, via valved supply lines 41, 47, 48 and 49, through a long high-pressure hose 50 (e.g., 250 ft., 0.25 in. ID) to a high-pressure lance or spray gun 51. The high-pressure lance can be used to peel weakly bonded paint/coatings; leaving the firmly bonded portion intact (sometimes 10–15% of the paint/coating needs to be removed).

The spray nozzles are arranged to accomodate the geometry of a ship tank or bilge being cleaned and the spray pattern is appropriate to cover all surfaces of the bulkheads, decks and reenforcing channels. Such nozzles include multi-degree spray butterworthing systems.

The high volume of working fluid moved by the pump module 12 provides a sufficient amount of hot solution to the working areas of the tanks or bilges being cleaned. Sufficiently high working pressures can be maintained since hazardous manual operations are not required.

Vacuum module 14 is a high volume (e.g., 3000 cfm), high velocity vacuum system for the return of solutions, control of vapor mists, and for providing ventilation in the work area. The vacuum module includes a stainless steel cyclonic separation tank 55 to provide mist-/liquid/solid separation of the air/liquid/solid mixture coming from ship tank 40. Cyclonic separation tank 55 has a surge tank capacity for partial heavy solid settling prior to transferring the solution mixture to the filter module 16. Air exhauster 58 (rated at 3000 cfm, for example) is used to airlift the chemical solutions from ship tanks or bilge 40 and deliver the solutions including removed solids and other materials to the cyclonic separation tank 55 via a vacuum hose line 59 (e.g., a 250 ft. 6 in. diameter flexible vacuum hose). The vacuum module is rated to air lift 75 gpm of liquid through a vertical lift of 100 feet, for example. The vacuum hose 59 is fitted at its lower end with an air driven eductor hose section 59', operated by the large volume of air (i.e., 3000 cfm) withdrawn through vacuum hose to sweep up the liquid from the bottom of the tank 40 and air mix it for transport to separator 55. The preferred ratio of the cross-sectional area of vacuum hose 59 to the eductor hose section 59' is in the ratio of 3 or 4 to 1. The vacuum module 14 can be operated independently, if desired, as a fluid transfer unit to remove usually dirty fluids, bilge water or sanitary wastes, etc., from difficult to manage areas. A coarse solids pump 60 connected to separation tank 55 (e.g., rated 75 gpm at 25 psi) via line 61, is used in conjunction with a level control, not shown, in tank 55 to automatically control the liquid level of the solution in the cyclonic separation tank. Coarse solids pump 60 pumps the returning liquid from separation tank 55 to the filtration module 16, via lines 61 and 62. If desired, the partial heavy solids and sludge (e.g., initial withdrawal from tank 40) which settles to the bottom of separation tank 55 can be withdrawn directly for disposal. A muffler, not shown, can be provided downstream from exhauster 58. Diaphragm pump 63 provides additional and/or alternate means for transferring solutions from tank 40, via a hose line 64 (e.g., 250 ft., 2 in. ID), to the filter module 16. Diaphragm pump 63 is driven at 100 psi, for example. An air supply is provided to diaphragm pump 63 via air hose 65.

Filter module 16 consists of two loops 66 and 67. Each of loops 66 and 67 includes a hydro-sieve 71 (e.g., 135 gpm flow capacity), a centrifugal pump 72 (e.g., 75 gpm at 25 psi), and a basket/bag filter 73 (e.g., a fine screen or bag). Loops 66 and 67 are each capable of handling the flow from vacuum module 14, via lines 61 and 76, or lines 61, 62 and 77, respectively. Either of loops 66 and 67 can also treat the recirculating solution returned directly from tank 40 via hose line 64 and diaphragm pump 63 located at the bottom of tank 40.

Hydro-sieves 71 are used to remove large solids from the returning liquid suspension transferred from vacuum module 14. The filtrate is collected in a sump and solids fall into a solids hopper for removal and disposal. Centrifugal pumps 72 move the filtered chemical solution through respective basket/bag filters 73 which operate to remove additional fine solids from the chemical solution returned from tank 40. Clean solution is then returned, via lines 81, 82 and 83 to tank module 10.

Separation of sludge from the returning chemical solution is achieved in the filter module 16. The sludge consists mainly of paint chips and rust. Sludge tank 85 is provided for storage of the sludge separated from the liquid in the hydro-sieves 71 and basket/bag filters 73. The basket/bag filters can be backwashable type, and the backwash with sludge directed, via lines 81, 82 and 87, to sludge tank 85 for later disposal.

In general, the system operates as follows: The chemical cleaning solutions are transported from storage tank module 10 through two hose lines to bilge tank 40 by means of high and/or low pressure pumps (pump module 12). The chemical solutions are sprayed onto the bilge tank surfaces to be treated by means of an automatic nozzle system and/or hand lance. The used chemical solutions together with accumulated dirt, rust, paint, etc., are removed and swept up from the bottom of tank 40 by means of the large diameter vacuum hose 59 and eductor 59' with appropriate smaller diameter suction heads and air transported via vacuum hose 59 to a cyclonic separator where the gaseous phase (air) is separated from the liquid phase (or mixture) containing the chemical solutions and solids (rust, paint chips, etc.). The liquid mixture from the cyclonic separator is pumped to a hydro-sieve filter 71 where coarse solids are separated from the solution which, in turn, is pumped through a basket filter where fine solids are removed. The filtered solution is then returned to the tank module 10 for refreshing, reheating and recirculation.

While the system is primarily for use in cleaning large surface areas in enclosed spaces, such as ship tanks and bilge spaces, it is easily adaptable for cleaning virtually any type of surface or containers.

The preferred chemical cleaning solution for use with this system is a 5 to 10 percent citric acid solution adjusted to a ph of about 3.5 using ammonia or triethanolamine (TEA) to clean and derust the surfaces down to bare metal. The citric acid solution is applied at approximately 160° F. using a series of 12 to 18 nozzles, for example. Then the cleaned metal surfaces are washed down with a 3 percent triethanolamine solution to neutralize and wash out the remaining citric acid solution. A hot passivating solution of 1 percent triethanolamine is then applied to the metal surface and dried to leave the surface slightly alkaline. The surface is then ready to be preserved with epoxy coatings.

The milder citric acid as a cleaning solution is preferred over hydrochloric acid which is more hazardous to operate with.

Six general phases are involved in surface preparation and coating of ship tanks and the like: Cleaning and degreasing of spaces; stripping old paint, scale, and flaky rust; application of hot pressurized citric acid spray to derust surfaces down to bare metal; application of hot passivating solution spray to prevent flash rusting; drying of surfaces; and, surface preservation with epoxy coatings.

Obviously many modifications and variation of the present invention are possible in light of the above teachings. It is therefore to be understood that within the scope of the appended claims the invention may be practiced otherwise than as specifically described.

What is claimed is:

1. A recyclable system for chemical cleaning and preparing enclosed surfaces of large tanks, comprising:

a. a supply storage means for preparing, holding and recirculating chemical cleaning solutions;

b. nozzle means strategically arranged within a tank being cleaned for spraying liquid chemical cleaning solutions onto all surfaces to be cleaned;

c. supply pump means for selectively delivering chemical cleaning solutions from said supply storage means at both high pressure—low volume and high volume—low pressure to said nozzle means for stripping and cleaning the surfaces to be cleaned;

d. a high-volume high-velocity vacuum means operable to air lift up to 75 gpm through a vertical lift of up to 100 feet communicating with the interior of the tank being cleaned for withdrawing a mixture of the sprayed liquid chemical cleaning solutions, air and vapor mists, along with sludge and solid wastes removed from the tank interior surfaces; said high-volume high-velocity vacuum means for air lifting liquid chemical cleaning solutions, vapor mists, sludge and solid wastes including a larger diameter air vacuum hose together with a smaller diameter air driven eductor hose section attached at the entrance of said larger diameter hose; said air driven eductor hose operating to withdraw liquid, sludge and solid wastes from the bottom of the tank being cleaned, to where it is mixed with air and vapor mists withdrawn through said larger diameter hose; said high-volume high-velocity vacuum means also operating to control vapor mists and provide ventilation in the area being cleaned;

e. said high-volume high-velocity vacuum means including separation means for separating the chemical cleaning solutions, vapor mist, sludge and solid wastes withdrawn from the tank being cleaned and delivered to said separation means, and exhausting the air from said mixture; said separation means including a cyclonic separation tank having a surge tank capacity for partial heavy solid settling prior to transfer of the returned mixture to said filtration means; said separation tank being provided with means for directly removing partially settled solids and sludge therefrom; said high-volume high-velocity vacuum means also including an air exhauster system operable to move air at a rate up to 3000 cfm through said larger diameter air vacuum hose and which air drives said eductor hose and operates to air lift the mixture of chemical solutions, sludge and solids withdrawn from the tank being cleaned to said separation means where the air is exhausted and the remaining mixture following partial heavy solid settling and removal is transferred to a filtration means;

f. said filtration means being connected to said ation means and being operable to separate remaining solids and sludge from the returning chemical solutions in the fluid mixture withdrawn from the tank being cleaned; said filtration means including hydro-sieve means operable to remove large solids from the returning fluid mixture, and a fine filter means to remove additional fine solids and sludge;

g. said vacuum means also including a separate and independent pump means operable to provide additional and alternate transfer of liquid suspension mixtures from said tank being cleaned directly to said filtration means;

h. means for delivering cleaned chemical cleaning solutions from said filtration means to said supply storage means for refreshing and recirculation of the solutions through the system for further cleaning use.

2. A chemical cleaning system as in claim 1 wherein said supply storage means includes a plurality of storage tanks for preparing the chemical cleaning solutions.

3. A chemical cleaning system as in claim 2 wherein heating and heat control means are included in said storage tanks.

4. A chemical cleaning system as in claim 2 wherein solution level and flow rate control means are included in each of said storage tanks.

5. A chemical cleaning system as in claim 2 wherein said plurality of supply storage tanks are operated independently and include at least one tank each for detergent cleaning solutions, caustic solutions, and acid solutions.

6. A chemical cleaning system as in claim 2 wherein said plurality of supply storage tanks are operated independently of each other for flexibility in supply, make-up and buffer operations, and include mixing means therein.

7. A chemical cleaning system as in claim 2 wherein said plurality of supply storage tanks are interconnected with each other and to said supply pump means with valved fluid flow lines for any of independent and variable multiple operations, mixing, and continuous recirculation of cleaning solutions.

8. A chemical cleaning system as in claim 1 wherein said supply pump means includes at least high pressure fluid pump and at least one low pressure fluid pump which can be alternately selected for use.

9. A chemical cleaning system as in claim 8 wherein said at least one high pressure fluid pump operates to provide high-pressure high-temperature cleaning solutions via said nozzle means for removal of hard rust.

10. A chemical cleaning system as in claim 8 wherein said at least one high-pressure fluid pump operates at approximately from 4 gpm at 2000 psi up to 10,000 psi, and said at least one low-pressure fluid pump operates at approximately 75 gpm at 100 psi.

11. A chemical cleaning system as in claim 1 wherein said nozzle means includes a plurality of nozzles arrayed according to the geometry of said tank to be cleaned to strategically spray hot chemical stripping/cleaning solutions to all area to be cleaned at pressures and volumes required.

12. A chemical cleaning system as in claim 1 wherein the ratio of the cross-sectional area of said larger diameter vacuum hose to the cross-sectional area of said smaller diameter eductor hose section is at least 3 to 1.

13. A chemical cleaning system as in claim 1 wherein a coarse solids pump means is provided to transfer the fluid mixture from said separation means to said filtration means.

14. A chemical cleaning system as in claim 1 wherein said fine filter means is backwashable, and the separated fine solids and sludge are transferred to a separate sludge storage means for later disposal.

15. A chemical cleaning system as in claim 1 wherein said filtration means includes a centrifugal pump for transferring fluid mixtures from said hydro-sieve means to said fine filter means.

16. A chemical cleaning system as in claim 1 wherein said nozzle means includes a high pressure spray gun for peeling weakly bonded paint coatings.

17. A chemical cleaning system as in claim 1 wherein said nozzles include multi-degree spray systems.

18. A chemical cleaning system as in claim 1 wherein said filtration means comprises two loops each of which includes a hydro-sieve for removing large solids, a pump means and a fine filter for removing sludge and additional fine solids; one loop being connected to said separator means, and the other loop being connected directly to said separate and independent pump means.

* * * * *